US008899507B2

(12) United States Patent
Abri et al.

(10) Patent No.: US 8,899,507 B2
(45) Date of Patent: Dec. 2, 2014

(54) CONDUIT RESERVOIR FOR INTAKE OF AN ELECTRICAL, OPTICAL OR FLUID CONDUIT

(75) Inventors: Omid Abri, Berlin (DE); Svenia Karge, Berlin (DE); Julian Verkin, Hohen Neuendorf (DE)

(73) Assignee: Karl Storz GmbH & Co. KG (DE)

( * ) Notice: Subject to any disclaimer, the term of this patent is extended or adjusted under 35 U.S.C. 154(b) by 207 days.

(21) Appl. No.: 13/555,966

(22) Filed: Jul. 23, 2012

(65) Prior Publication Data

US 2013/0020426 A1 Jan. 24, 2013

(30) Foreign Application Priority Data

Jul. 21, 2011 (DE) ..... 10 2011 079 598

(51) Int. Cl.
*B65H 75/38* (2006.01)
*B65H 75/44* (2006.01)

(52) U.S. Cl.
CPC ..... *B65H 75/4452* (2013.01)
USPC ..... 242/388.6; 242/388.9; 242/388.91

(58) Field of Classification Search
USPC ..... 242/388.6–388.9, 388.91, 388
See application file for complete search history.

(56) References Cited

U.S. PATENT DOCUMENTS 2,262,587 A 11/1941 Kaempf
4,174,816 A * 11/1979 Olson ..... 242/272
6,065,710 A * 5/2000 Richter et al. ..... 242/388.6
6,874,722 B2 * 4/2005 Wei ..... 242/378
7,000,863 B2 * 2/2006 Bethea et al. ..... 242/388.1
2010/0320304 A1 * 12/2010 Iguchi et al. ..... 242/388.91

FOREIGN PATENT DOCUMENTS

| | | | |
|---|---|---|---|
| CH | 184388 | A | 5/1936 |
| DE | 1574306 | A1 | 6/1971 |
| DE | 3128545 | A1 | 2/1983 |
| DE | 202007006899 | U1 | 10/2007 |
| DE | 202007016599 | U1 | 2/2008 |
| GB | 1092945 | A | 11/1967 |
| WO | 2004020023 | A2 | 3/2004 |
| WO | 2008025810 | A1 | 3/2008 |

OTHER PUBLICATIONS

German Search Report; Application No. DE 10 2011 079 598.7; Issued: Mar. 1, 2012; 5 pages.

* cited by examiner

*Primary Examiner* — Sang Kim
(74) *Attorney, Agent, or Firm* — St. Onge Steward Johnston & Reens LLC

(57) ABSTRACT

A conduit reservoir for intake of an electrical or optical cable or of a hose or other conduit to conduct or transmit at least either a fluid, a signal or electric current includes a carrier that can rotate about a predetermined rotation axis, conduit devices on the carrier and a conduit path defined by the conduit devices and having a first portion, a second portion and a third portion, such that the conduit path is defined by the conduit devices in such a way that a conduit originally inserted in the second portion of the conduit path, upon a rotation of the carrier in a first rotation direction about the rotation axis, is simultaneously inserted in the first portion and in the third portion (31) of the conduit path. The conduit devices are configured to permit a movement of a conduit along the conduit path.

14 Claims, 5 Drawing Sheets

CONDUIT RESERVOIR FOR INTAKE OF AN ELECTRICAL, OPTICAL OR FLUID CONDUIT

CROSS-REFERENCE TO RELATED APPLICATIONS

The present application claims priority of German patent application No. 10 2011 079 598.7 filed on Jul. 21, 2011.

FIELD OF THE INVENTION

The present invention relates to a conduit reservoir for intake of an electrical or optic cable or of a hose or other conduit for conducting or transmitting at least either a fluid, a signal or electric power.

BACKGROUND OF THE INVENTION

Given the number of electrically operated devices and the increasing networking of devices for data exchange, there is an increase in the number of necessary lines for transmitting electric power and electric and optical signals. This is particularly true, as well, for medical treatment facilities, in which moreover compressed air, water or other fluids are transmitted. The result, referred to colloquially as "cable salad," is devoid of aesthetic value, makes maintenance difficult, and poses a risk of accidents and of damage to power lines by persons treading on them.

Patent DE 20 2007 016 599 U1 describes a cable winding device in which a main cable is wound about the upper part of a winding coil and a complementary cable of equal length is wound about the lower part of the winding coil.

In DE 31 28 545 A1, a cable roll-up device is described in which a dividing wall divides up a winding cylinder into a first part with a first, larger diameter and a second part with a second, smaller diameter. A cable that is to be wound up enters through a corresponding recess in the dividing wall between the first and the second parts of the winding cylinder. In wound-up condition, a few loose rounds of a non-extensible part of the cable are situated on the second part of the winding cylinder and several mutually contiguous rounds on the first part of the wind-up cylinder. In unwound condition, the first part of the winding cylinder is empty and the non-extensible part of the cable in the second part of the winding cylinder is wound up in a few tightly, mutually contiguous rounds.

In DE 20 2007 006 899 U1, a traction-operated cable winding device is described in which a portion of a cable, non-removable from the cable winding device, is wound loosely or tightly inside a cylindrical dividing wall. When a windable portion of the cable is wound up outside on the cylindrical dividing wall, the non-removable portion of the cable is wound closely. When the wound-up portion of the cable outside the cylindrical dividing wall is unwound or removed, the winding of the portion remaining in the cable winder is loosened.

DE 1 574 306 discloses a device for storing and operating electrical connecting cables, in which an electric contact to an end of a cable that rotates with a winding spool is produced by "electric grinder contact" between stationary contact sleeves and counter-grinding sleeves that rotate with the cable end.

A grinder contact, as described in DE 1 574 306 A, is unsatisfactory for many applications. In particular, a sufficiently reliable transmission of electric current or electric signals is possible for many applications only at considerable expense. Corresponding devices for transmitting optical signals or light power (for example, illuminating light for endoscopic applications) still require markedly greater expense and can only be satisfactory if, at the coupling point, the optical axis corresponds to the axis of rotation.

In addition, the devices described in DE 31 28 545 A1 and a few other cited publications comprise a series of disadvantages. In particular, an overall comparatively large conduit length is required because part of the conduit always remains in the cable roll-up device. The movements of this portion inside the cable roll-up device can be predetermined, at least to some extent, and constitute a source of malfunctions.

SUMMARY OF THE INVENTION

An object of the present invention consists in providing an improved conduit reservoir for the intake of an electrical or optical cable or of a hose or other conduit for conducting or transmitting at least either a fluid, a signal or power.

This object is achieved by the contents of the independent claims.

Refinements are indicated in the dependent claims.

Embodiments of the present invention are based on the idea of configuring a conduit reservoir or a line roll-up device in which, by rotating a carrier, a conduit is laid down in a conduit path or can be removed from it, in such a way that the conduit can be moved or slid along the conduit path. This allows, in particular, an essentially symmetrical configuration of the conduit path, in which a conduit, starting from a central area, is simultaneously laid down in or removed from two sections of the conduit path. The resulting simultaneous shortening or lengthening of both ends of the conduit can be modified by the mobility of the line along the conduit path in order that only one end of the line—but at double the speed—is shortened or lengthened.

A conduit reservoir for intake of an electrical or optical cable or of a hose or other conduit for conducting or transmitting at least either a fluid, a signal or power, includes a carrier that can rotate about a predetermined rotation axis, conduit devices at the carrier and a conduit path defined by the conduit devices with a first portion, a second portion and a third portion, such that the conduit path is defined by the conduit devices in such a way that a conduit, laid down originally in the second portion of the conduit path, with a rotation of the carrier in a first rotation direction around the rotation axis, is laid down simultaneously in the first portion and in the third portion of the conduit path, and such that the conduit devices are configured to make possible a movement of a conduit along the conduit path.

The conduit reservoir is in the position, like a conventional cable roll-up apparatus, to receive a conduit by winding it, so that the conduit is simultaneously shortened or lengthened at both ends from a center portion. The inserted portion or length of the conduit can be fed out again by rotation of the carrier in a second direction, which is opposite the first direction. Contrary to simple apparatuses, widely distributed in numerous households in the past, for example for telephone lines, a conduit taken up in the conduit reservoir, on the contrary, can be moved or slid along the conduit path, especially both with the carrier stationary or else simultaneously rotating, and largely or completely independently of the quantity momentarily taken up by the conduit reservoir. In this case, a movement of a conduit along the conduit path is intended to mean a movement of the slack or tensed conduit and without generating loose loops of undefined shape and arrangement.

An advantage of the conduit reservoir consists in the fact that no rotary joint is required and nevertheless a one-sided extension or shortening of the conduit is possible. The conduit reservoir is therefore suited also for multiple-line or many-line electrical or optical cables, for transmitting electrical or optical signals with high bandwidth, for light conductor cables to transmit light of high voltage (for example, illuminating light for endoscopy), for conduits for compressed air, water, blood or other fluids, in which rotary joints can be performed only at considerable expense. The conduit reservoir can also be suitable for hybrid lines for simultaneous transmission of electrical and/or optical signals and/or power and/or fluids.

With a conduit reservoir as described here, the conduit devices include in particular a roller that can rotate with respect to the carrier.

One or more rollers that define the conduit path can make possible a particularly smooth-running capacity for sliding or moving of a conduit along the conduit path.

In a conduit reservoir as described here, in which the conduit devices include a roller that can rotate with respect to the carrier, the rotary axis of the roller is, in particular, parallel to the axis of rotation of the carrier.

The axis of rotation of the roller is, in particular, exactly or essentially parallel to the rotation axis of the carrier, such that an angle between the rotation axis of the roller and the rotation axis of the carrier, for example, is no greater than 5 degrees or no greater than 2 degrees or no greater than 1 degree. A small angle gap or a small angle between the rotation axis of the carrier and the rotation axis of the roller can be advantageous in an embodiment that is described below, in order to reduce the friction of a conduit moved along the conduit path.

The conduit devices include, in particular, at least three rollers in the first portion of the conduit path and at least three rollers in the third portion of the conduit path.

As shown in the embodiments described hereinafter, in each case four or still better three rollers in each portion of the conduit path can allow simultaneously a relatively large diameter of the individual rollers and a relatively good approximation of the shape of a portion of the conduit path to the circular. Large diameters of the individual rollers and a low number of rollers are advantageous in view of the friction arising in an actual conduit with each bending cycle. With respect to the most constant possible translation ratio between a torque on the carrier and a tractive force on the conduit, it is advantageous if the shape of the first portion and of the third portion of the conduit path are as close as possible to circular form.

A conduit reservoir as described also includes, in particular, a first stationary guide device at an area of the conduit path that borders on the first portion of the conduit path and a second stationary guide device at an area of the conduit path that borders on the third portion of the conduit path, such that the rollers on the carrier and the stationary guide devices are so disposed that, at a predetermined position of the carrier, a first distance between a tangent through the first guide device on the first portion of the conduit path and the rotation axis of the carrier is essentially maximal, and a second distance between a tangent through the second guide device on the third portion of the conduit path and the rotation axis of the carrier is essentially minimal.

A stationary guide device can include one or more rollers or glide surfaces to guide a conduit in one or, in particular, in two directions perpendicular to one another, for example in the form or manner of a hawse pipe. Either the first or the second stationary guide device can include a clamp or other securing means for fastening or securing a conduit, at least at specific points.

The distances of the tangents through the guide devices to the associated portions of the conduit path are the lever arms or lengths of the lever arms, with which a tractive force on the conduit is translated into torque on the carrier (or vice versa). In the described arrangement, a maximal lever arm on the first portion of the conduit path coincides (essentially) with a minimal lever arm on the third portion of the conduit path. The waviness of the entire translation ratio between tractive force on the conduit and torque on the carrier can thereby be reduced, especially if, with a uniform distribution of the rollers, alternatively a maximum of the lever arm on the first portion coincides with a minimum of the lever arm on the third portion and a minimum of the lever arm on the first portion coincides with a maximum of the lever arm on the third portion.

A conduit reservoir as described here includes in particular a first stationary guide device at an area of the conduit path that borders on the first portion of the conduit path, and a second stationary guide device at an area of the conduit path that borders on the third portion of the conduit path, so that the rollers on the carrier and the stationary guide devices are disposed in such a way that a first angle between a first position of the carrier, in which a conduit directed by the first stationary guide device directly touches a first roller on the first portion of the conduit path, and a second position of the carrier, in which the conduit directed by the second stationary guide device directly touches a first roller on the third portion of the conduit path and a second angle between the second position of the carrier and a third position of the carrier, in which the conduit guided by the first stationary guide device directly touches a second roller neighboring on the first roller on the first portion of the guide path, are essentially equal.

The first angle and the second angle are exactly or essentially equal, such that in particular one angle differs from the other angle by at most 20 degrees or at most 10 degrees or at most 5 degrees. The angular distances between the positions of the carrier, in which the conduit guided by the stationary guide devices directly touches a roller in the first portion or a roller in the third portion of the conduit path, therefore alternate with one another periodically or essentially periodically. This can make possible an especially small variation of the translation ratio between tractive force on the conduit and torque on the carrier.

In a conduit reservoir as described here, the conduit devices can include a glide surface.

A glide surface is in particular a surface of a body or of a coating of Teflon, ceramic, another sinter material or other material that generates a low friction resistance or a low gripping or gliding friction. The glide surface is, in particular, optimized to the properties of the surface of the conduit for whose use the conduit reservoir is intended. As shown by the embodiments illustrated below, glide surfaces can be advantageous with respect to the necessary structural space and the achievable curvature radii, in particular in the second portion of the conduit path or in the areas of transition between the first portion and the second portion of the conduit path and of transition between the second portion and the third portion of the conduit path.

In a conduit reservoir as described here, the carrier includes in particular a flat-formed component that extends in a plane perpendicular to the rotation axis of the carrier.

A flat-form component is in particular a board, sheet metal or other component whose dimensions within the plane perpendicular to the rotation axis are essentially greater than those perpendicular to the plane or parallel to the rotation axis. The carrier can include several flat-form components. In particular, the first portion of the conduit path is positioned between a first flat-form component and a second flat-form component, and the third portion of the conduit path is positioned between the second flat-form component and a third flat-form component.

In a conduit reservoir as described here, the carrier includes in particular a flat-form component with an opening, such that the second portion of the conduit path runs through the opening.

In particular, the flat-form component is situated between the first portion and the third portion of the conduit path.

In a conduit reservoir as described here, the first portion of the conduit path, in particular, is positioned in a first plane and the third portion of the conduit path in a second plane, such that the first plane and the second plane are parallel to one another and perpendicular to the rotation axis of the carrier.

In particular, the first portion of the conduit path, inside the first plane, and the third portion of the conduit path, inside the second plane, each has the shape of a polygon with rounded corners. The first and third portions of the conduit path are positioned, in particular, exactly or essentially in the first plane and third plane, respectively. As is made clear through a description of an embodiment below, a slight displacement of the first or third portion from the first or third plane can be advantageous in order to lengthen the conduit path, for example, by a screw-type shape.

In a conduit reservoir as described here, the carrier is positioned in particular between the first plane and the second plane.

This is true in particular if the carrier includes a single flat-form component or consists of the same. This can allow the conduit reservoir an especially simple and compact structure.

In a conduit reservoir as described here, the first portion and the third portion of the conduit path are positioned parallel to one another, at least in some areas, such that the second portion connects the first portion and the third portion to one another in such a way that a conduit moving along the conduit path moves in the opposite direction in the first and third portions.

A conduit reservoir as described here includes, in addition, a torque source, in particular, that is coupled with the carrier in order to exert torque on the carrier in the first rotation direction.

The torque source includes in particular a spiral spring or other spring or an electromotor or a weight in the earth's gravitational field. The force of a spring or the impact of a weight is converted into torque, for example, by means of a cord wound onto an axle of the carrier. In particular, the constant impact of a weight in the homogeneous gravitational field of the earth allows the generation of a constant torque. The torque source causes the conduit to be drawn into the conduit reservoir or incorporated into the conduit reservoir as long as a tractive force acting on the conduit from the outside does not reach a threshold value.

A conduit reservoir as described here can also comprise a blocking or braking device for releasable blocking of the carrier or of a conduit that has been fed into the conduit reservoir.

The blocking or braking device can be configured to act directly on the carrier or on an axle that defines the rotation axis of the carrier. Alternatively, the blocking or braking device can be configured to influence the torque generated by the torque source, in particular to controllably block said torque source or to switch it on and off in other manner. Alternatively, the blocking or braking device can be configured to act directly on a conduit taken up in the conduit reservoir, for example by fastening the conduit in one of the aforementioned stationary guide devices.

A direct impact of the blocking or braking device on the carrier or on the axle of the carrier or the torque source can be produced more easily than a direct impact on the conduit. For the blocking or braking device to have a direct impact on the conduit, it can be advantageous if the conduit is constantly under tractive tension inside the conduit reservoir and thus is unable to depart from the conduit path determined by the conduit devices.

The blocking or braking device can be configured to be at least either activated or deactivated by means of a press-button, a lever, a sliding device or other user interface. Alternatively or in addition, the blocking or braking device can be configured to be at least either activated or deactivated by moving the conduit. For example, the blocking or braking device can be configured to be activated when the conduit and the carrier are at rest, after removal from the conduit reservoir, by a pull on the conduit and in order to be deactivated by another tug, especially in backward direction, on the conduit.

In a conduit reservoir as described here, the conduit devices on the first portion of the conduit path and the conduit devices on the third portion of the conduit path are each positioned and configured so that the first portion of the conduit path and the third portion of the conduit path each encircle the rotation axis of the carrier more than once.

In particular, the first portion and the third portion of the conduit path each encircle the rotation axis of the carrier at least one and a half times, twice, three times or four times. If the first and third portions of the conduit path each encircle the rotation axis of the carrier more than once, the conduit reservoir can take in correspondingly more conduit.

In a conduit reservoir as described here, the first portion and the third portion of the conduit path each encircle the rotation axis of the carrier, in particular, in spiral or screw-type manner.

A portion of the conduit path encircles the rotation axis of the carrier in spiral manner if it is situated in a plane and has more than one winding, so that several windings are situated parallel to one another inside the plane. The spiral-type portion of the conduit path, in particular, thus does not have the shape of an Archimedes spiral $r(\phi)=a\cdot\phi$, but rather fulfills, for example, the function $r(\phi)=a\cdot\phi\cdot f(\phi)$, where $f(\phi)$ for example describes a polygon with rounded corners.

A portion of the conduit path encircles the rotation axis of the carrier, in particular, in screw-shape if it is in the shape of a curve with constant inclination around the mantle surface of a cylinder, so that the cylinder in particular does not have a circular cross-section but rather a cross-section in the form of a polygon with rounded corners.

In a conduit reservoir as described here, in which the first portion and the third portion of the conduit path each encircle the rotation axis of the carrier in screw-shaped manner with a predetermined pitch, the carrier is mounted, in particular, in such a way that a rotation of the carrier by 360 degrees is accompanied by an axial sliding of the carrier by a predetermined pitch.

Mounting the carrier in this manner makes it possible to lay down the conduit in the conduit path during the rotation of the carrier in essentially non-variable locations or to remove it from the conduit path.

BRIEF DESCRIPTION OF THE DRAWINGS

Embodiments are described in greater detail hereinafter with reference to the appended drawings, which are as follows.

DETAILED DESCRIPTION OF THE INVENTION

Figure 1:
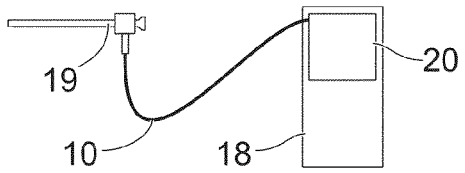
FIG. 1 shows a schematic depiction of medical devices connected by a conduit.

FIG. 1 shows a schematic depiction of a conduit 10, which connects a stationary medical apparatus 18 with a mobile medical apparatus 19. The stationary medical apparatus 18 includes, for example, a light source to generate illuminating light and/or a source that provides a flushing liquid and/or a switch to record, store and/or evaluate image signals. The mobile medical apparatus 19 is, for example, an endoscope for medical applications. The conduit 10 includes, for example, several electrically conductive lines to transmit image and/or control signals, a light conductor cable to transmit illuminating light and a lumen or a hose to transmit or conduct a flushing fluid. The stationary medical apparatus 18 also includes a conduit reservoir 20, as is described in detail hereinafter with reference to the additional drawings.

The conduit 10 must comprise a sufficient length in order to allow medical staff freedom of movement with respect to the patient. Ideally, the conduit 10 is long enough so that medical staff can use the mobile medical apparatus on the patient from all sides. Without the conduit reservoir 20, the necessary length of the conduit 10 would result in having the conduit 10 lying on the floor in many situations. There, the conduit 10 is exposed to the risk of damage if medical staff accidentally tread on the conduit 10 or move rollable or movable apparatus across it. In addition, the conduit 10 lying on the floor is especially prone to a risk of accidents.

The conduit reservoir 20 is configured to absorb a changeable quantity or a changeable length of the conduit 10. The conduit 10 can therefore be absorbed partly or extensively by the conduit reservoir 20 in many situations instead of remaining on the floor of the medical treatment facility. The conduit reservoir 20 can be integrated into the stationary medical apparatus 18 or can be provided as a separate component.

Figure 2:
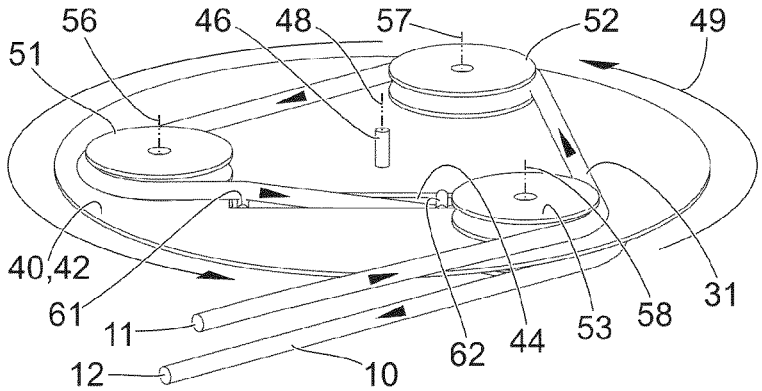
FIG. 2 shows a schematic depiction of a conduit reservoir.

FIG. 2 shows a schematic depiction of a conduit reservoir 20, which can be employed in the example described above with reference to FIG. 1. The conduit reservoir includes a carrier 40, which consists essentially of a circular flat-form component 42. The flat-form component 42 comprises an opening 44 and is mechanically connected with an axle 46, which defines a rotation axis 48 perpendicular to the flat-form component 42.

Rollers 51, 52, 53 are mounted on the carrier 40 or on the flat-form component 42. Each roller 51, 52, 53 can rotate with respect to the carrier 40 about a rotation axis 56, 57, 58. The rotation axes 56, 57, 58 of the rollers 51, 52, 53 are parallel to one another and to the rotation axis 48 of the carrier 40. The rotation axes 56, 57, 58 of the rollers 51, 52, 53 are positioned in an equilateral triangle symmetrical to the rotation axis 48 of the carrier 40.

Three additional rollers, not visible in FIG. 2, are mounted on an opposite side of the carrier 40, turned away from the observer, and mirror-symmetrical to the rollers 51, 52, 53 visible in FIG. 2 with respect to the plane defined by the flat-form component 42. In addition, rollers 61, 62 are positioned at the opening 44 in the flat-form component 42. The rollers 61, 62 can rotate around rotation axes parallel to the plane defined by the flat-form component 42 that are not shown and numbered separately in FIG. 2.

The rollers 51, 52, 53 each comprise a peripheral groove whose cross-section is adjusted to the cross-section of the conduit 10. The rollers 51, 52, 53, 61, 62 visible in FIG. 2 and the rollers not visible in FIG. 2 define a conduit path along which the conduit 10 can be moved. Single arrows in FIG. 2 indicate a movement of the conduit along the conduit path defined by the rollers 51, 52, 53, 61, 62 that arises when a greater tractive force is exerted at the second end 12 of the conduit than at its first end 11. When a tractive force acting on the first end 11 of the conduit is greater than a tractive force acting on the second end 12 of the conduit 10, a movement of the conduit 10 in the opposite direction can be caused.

The conduit path defined by the rollers 51, 52, 53, 61, 62 includes several portions. The rollers 51, 52, 53 whose rotation axes 56, 57, 58 are perpendicular to the flat-form component 42 and parallel to the rotation axis 48 of the carrier 40, define a first portion 31 of the conduit path, which is situated essentially in a plane parallel to the flat-form component 42 and perpendicular to the rotation axis 48 of the carrier 40. The first portion 31 of the conduit path becomes visible in the depiction in FIG. 2 especially owing to the area of the conduit 10 that is found therein.

A third portion of the conduit path is defined by the rollers, not visible in FIG. 2, that are symmetrical to the rollers 51, 52, 53. The third portion of the conduit path is situated symmetrically to the first portion in a plane that is likewise parallel to the flat-form component 42 and perpendicular to the rotation axis 48 of the carrier 40. The third portion of the conduit path runs, in particular, largely parallel to the first portion of the conduit path.

The first portion and the third portion of the conduit path each have approximately the shape of an equilateral triangle with rounded corners corresponding to the radii of the rollers 51, 52, 53.

The first portion and the third portion of the conduit path are connected by a second portion of the conduit path, which is defined essentially by the rollers 61, 62 at the opening 44 in the flat-form component 42 and extends essentially between these two rollers 61, 62. This second portion of the conduit path is not situated in a plane parallel to the flat-form component 42, but instead is inclined with respect to it.

If the conduit 10 is guided through stationary guide devices, not shown in FIG. 2, then by rotation of the carrier 40 with the rollers 51, 52, 53 around the rotation axis 48 it can be inserted simultaneously into the first portion and into the third portion of the conduit path and/or, upon rotation in the opposite direction, can be removed from there again. In particular, a rotation of the carrier 40 with the rollers 51, 52, 53 in the first rotation direction, indicated by arrows 49 in FIG. 2, causes an insertion of the conduit 10 into the first and third portions of the conduit path defined by the rollers 51, 52, 53, 61, 62 up to the condition shown in FIG. 2. With a rotation in a second, opposite direction, the conduit can be removed again from the first and third portions of the conduit path.

Figure 3:
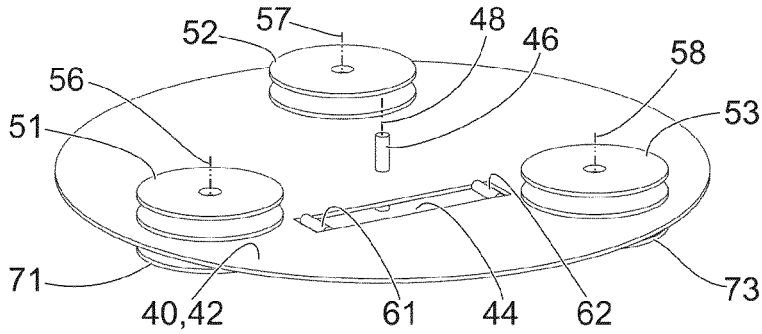
FIG. 3 shows another schematic depiction of the conduit reservoir from FIG. 2.

FIG. 3 shows an additional schematic axonometric depiction of the conduit reservoir from FIG. 2. Unlike in the depiction in FIG. 2, no conduit is inserted into the conduit path defined by the rollers on the carrier 40. In addition, the carrier 40 is shown in a position rotated by a small angle with respect to the position in FIG. 2. Contrary to FIG. 2, at least two rollers 71, 73 can be at least partly recognized in FIG. 3 on the side of the flat-form component 42 turned away from the observer.

Figure 4:
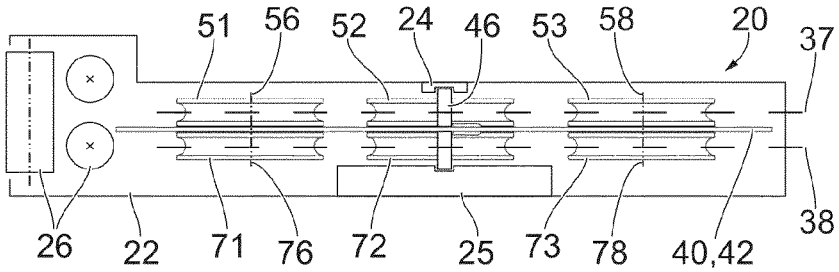
FIG. 4 shows another schematic depiction of the conduit reservoir from FIGS. 2 and 3.

FIG. 4 shows an additional schematic depiction of the conduit reservoir from FIGS. 2 and 3. The plane of projection of FIG. 4 is parallel to the rotation axis 48 of the carrier 40 and to the rotation axes 56, 57, 58, 76, 78 of the rollers 51, 52, 53, 71, 72, 73.

All rollers 51, 52, 53, 71, 72, 73 on both sides of the flat-form component 42 can be recognized in FIG. 4. In the depiction in FIG. 4, the rotation axes of two rollers 52, 72 are hidden behind the axle 46 of the carrier 40. The rotation axes 56 and 76 or 58 and 78 of two rollers 51 and 71 or 53 and 73 placed opposite or symmetrical to one another are situated, in each case, on a straight line. The two rollers 51 and 71; 52 and 72; 53 and 73, opposite one another or placed symmetrically in relation to the flat-form component 42, can rotate independently of one another, because, as can be recognized in particular in FIG. 2, they rotate in opposite directions upon a movement of the conduit 10 along the conduit path defined by the rollers 51, 52, 53, 61, 62, 71, 72, 73.

In addition to features already recognizable in FIGS. 2 and 3, a housing 22 and guide rollers 26, stationary with respect to the housing, with rotation axes in two directions perpendicular to one another, can be recognized in FIG. 4. Instead of the stationary guide rollers 26 or in addition to them, another device for guiding a conduit can be foreseen, for example in the style of a hawse pipe. This device, in particular, comprises a surface on which the conduit can glide with low friction. In addition, the surface in particular has large curvature radii and a coating that is adjusted to the expected conduit with respect to low friction.

In addition, bearings 24, 25 for the axle 46 on the carrier 40 can be recognized in FIG. 4. The bearing 25 includes a torque source to generate torque in the first rotation direction 49 shown in FIG. 2, for example a spiral spring or an electromotor. The torque source is, in particular, encapsulated in the bearing 25. A coupling for intake of the end of the axle 46 facing the bearing 25 can be foreseen on the bearing 25. Said coupling has, in particular, a non-rotation-symmetrical shape (for example, a polygonal cross-section or teeth) in order to make possible a form-locking transmission of torque between the coupling and the correspondingly configured end of the axle 46. The construction of the conduit reservoir 20 can be simplified by a detachable coupling between the coupling on the bearing 25 and the end of the axle 46.

In addition, shown positioned in broken lines in FIG. 4 are the planes 37, 38 in which the first portion 31 or the third portion of the conduit path defined by the rollers 51, 52, 53, 71, 72, 73 are situated. The planes 37, 38 are perpendicular to the plane of projection of FIG. 4 and to the rotation axis 48 of the carrier 40.

Figure 5:
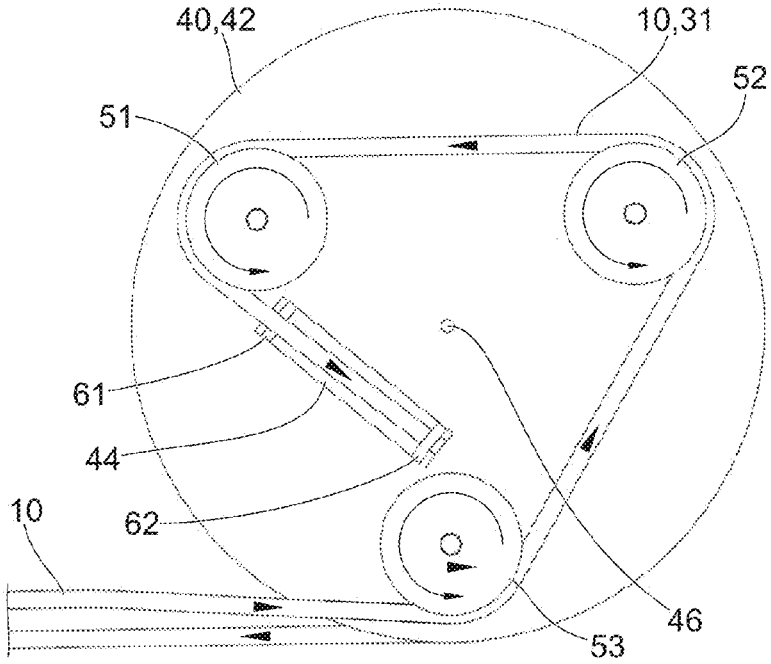
FIG. 5 shows another schematic depiction of the conduit reservoir from FIGS. 2 through 4.
Figure 6:
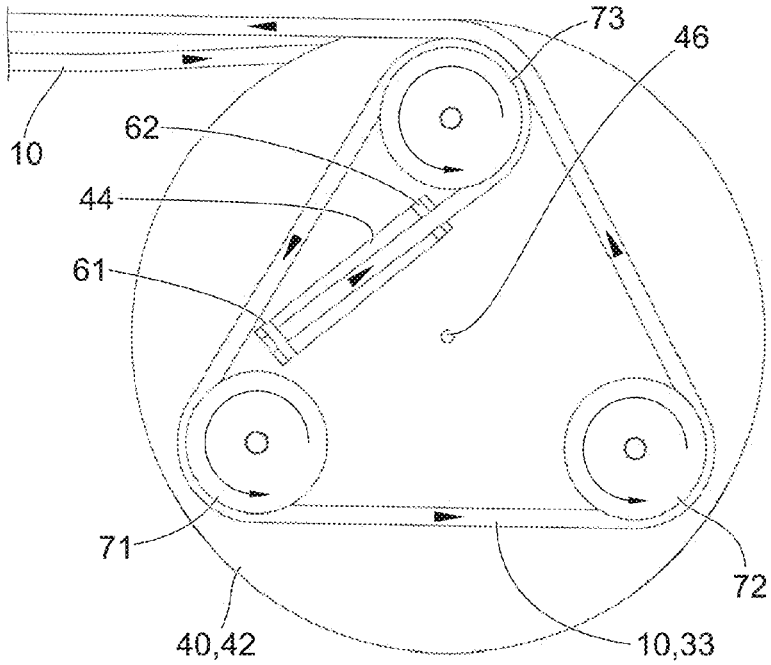
FIG. 6 shows another schematic depiction of the conduit reservoir from FIGS. 2 through 5.

FIGS. 5 and 6 show additional schematic depictions of the conduit reservoir from FIGS. 2 through 4. The planes of projection of FIGS. 5 and 6 are perpendicular to the rotation axis 48 of the carrier 40 and to the plane of projection of FIG. 4 and parallel to the flat-form component 42. FIGS. 5 and 6 show the flat-form component 42 from two opposite sides. The rollers 51, 52, 53 that define the first portion 31 of the conduit path are visible in FIG. 5; the rollers 71, 72, 73 that define the third portion 33 of the conduit path can be seen in FIG. 6. In FIGS. 5 and 6, in addition, a movement direction of the conduit 10 and the resulting rotation directions of the rollers 51, 52, 53, 71, 72, 73 are indicated by arrows.

Figure 7:
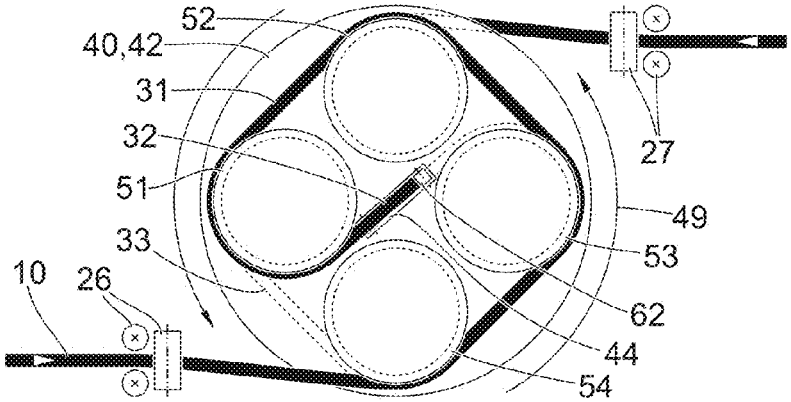
FIG. 7 shows a schematic depiction of an additional conduit reservoir.

FIG. 7 shows a schematic depiction of an additional conduit reservoir, which resembles in a few features the conduit reservoir described above with reference to FIGS. 2 through 6. In particular, the conduit reservoir of FIG. 7 includes a flat-form component 42. On the side of the flat-form component 42 turned toward the observer, four rollers 51, 52, 53, 54 in relation to the flat-form component 42 are mounted to rotate around rotation axes perpendicular to the plane of projection of FIG. 7 and define a first portion of a conduit path. Positioned at an opening 44 similarly as in the conduit reservoir of FIGS. 2 through 6 are guide rollers, one of which is covered by the conduit 10. The second guide roller 62 at the opening 44 is visible in FIG. 7.

In relation to the plane of the flat-form component 42, symmetrically to the rollers 51, 52, 53, 54, four additional rollers are mounted on the side of the flat-form component 42 turned away from the observer and are not visible in FIG. 7. These four additional rollers define a third portion 33 of the conduit path, which is indicated in FIG. 7 by broken lines, to the extent that it is not covered in the illustrated projection by the first portion 31.

The first and third portions of the conduit path each have essentially the shape of a square with rounded corners corresponding to the radius of the rollers 51, 52, 53, 54. The first and third portions of the conduit path are essentially parallel to one another, similarly as in the conduit reservoir of FIGS. 2 through 6.

Also depicted in FIG. 7 are stationary guide rollers 26, 27 for the conduit 10 as are already indicated in FIG. 4. Unlike in the conduit reservoir of FIGS. 2 through 6, the stationary guide rollers 26, 27 for the conduit 10, opposite one another or based on the rotation axis of the flat-form component 42, are positioned essentially symmetrical to one another.

The movement of the conduit 10 caused by a rotation of the carrier 40 in the first rotation direction 49 is indicated by arrows on the conduit 10. Thus the conduit 10 is inserted simultaneously in the first portion of the conduit path defined by the rollers 51, 52, 53, 54 and in the third portion of the conduit path that is symmetrically positioned and not visible in FIG. 7. With a rotating carrier 40, this movement can be superimposed from the stationary guide rollers 26 to the stationary guide rollers 27 or vice versa by a movement of the conduit 10 along the conduit path defined by the rollers 51, 52, 53, 54, 62. This movement of the conduit 10 along the conduit path defined by the rollers 51, 52, 53, 54, 62 can also occur with a non-moving carrier 40.

Figure 8:
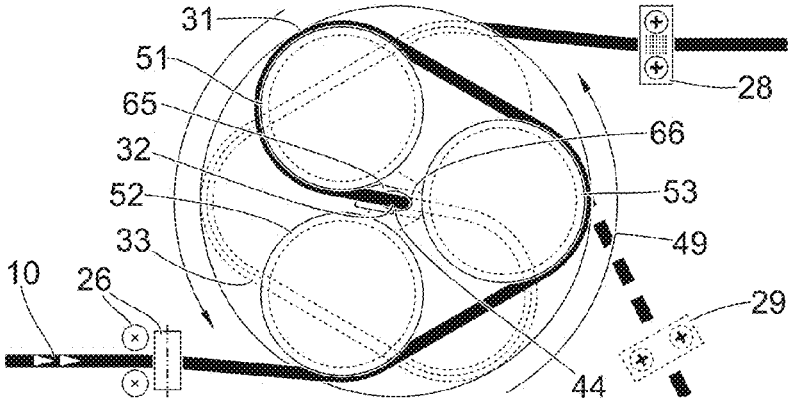
FIG. 8 shows a schematic depiction of an additional conduit reservoir.

FIG. 8 shows a schematic depiction of an additional conduit reservoir, which resembles in a few features the conduit reservoir described above with reference to FIGS. 2 through 7. The conduit reservoir of FIG. 8 is distinguished from the conduit reservoir of FIG. 7 in particular in that only three instead of four rollers 51, 52, 53 are mounted at each side of the flat-form component 42. The rollers 51, 52, 53 are positioned in the form of an equilateral triangle symmetrical to the rotation axis of the carrier 40. Said rollers 51, 52, 53 define a first portion of a conduit path, which has essentially the shape of an equilateral triangle with rounded corners corresponding to the radius of the rollers 51, 52, 53. In a comparison of FIGS. 7 and 8 it can be recognized that in using three rather than four rollers on a side of the flat-form component 42, the individual rollers 51, 52, 53 can have a greater radius, so that the friction by mutual bending can be reduced.

The rollers positioned on the side of the flat-form component 42 turned away from the observer, and the third portion 33 of the conduit path defined by said rollers, are not visible in FIG. 8 but are indicated by broken lines. The third portion 33 of the conduit path also has approximately the shape of an equilateral triangle with rounded corners corresponding to the radius of the rollers.

The third portion of the conduit path and the arrangement of the rollers that define it are rotated 60 degrees from the first portion and the arrangement of the rollers 51, 52, 53. This arrangement, together with the use of glide surfaces 65, 66 instead of rollers on the second portion 32 of the conduit path, contributes to the fact that more structural space is available for the second portion 32 and greater curvature radii can be achieved in the second portion 32. The glide surfaces 65, 66 are positioned symmetrically to the opening 44 in the flat-form component 42 on the side of the flat-form component 42 that is turned toward the observer or on the side turned away from the observer.

The conduit reservoir shown in FIG. 8 is distinguished from the conduit reservoirs described above with reference to FIGS. 2 through 7, in addition, by the fact that on one side stationary guide rollers 26 and on an opposite side a fastening 28 in the form of a screwable clamp are provided for the conduit 10. In the conduit reservoirs of FIGS. 2 through 7, in addition, the stationary guide rollers 27 can each be replaced by a fastening. The fastening 28 has the effect that when the carrier 40 is at rest, the conduit 10 can no longer be slid along the conduit path 31, 32, 33 defined by the rollers 51, 52, 53 and by the glide surfaces 65, 66. Another effect of the fastening 28 is that the end of the conduit 10 that is not secured by the fastening 28 can be drawn into or inserted into the first and third portions of the conduit path upon rotation of the carrier 40 at double speed or, in the opposite rotation direction, can be removed from them.

Shown in broken lines in FIG. 8 is an alternative fastening 29 or a fastening of the conduit 10 at an alternative site, to which reference is made below.

In the conduit reservoir from FIGS. 7 and 8, the openings 44 in the flat-form component 42 are situated in each case in the center of said component. In these conduit reservoirs, the flat-form components 42 therefore cannot simply be mounted to rotate by means of a continuous axle, as is shown in FIG. 4. Instead, additional flat-form components, for example, as seen by the observer, are positioned ahead of the first portion of the conduit path and behind the third portion of the conduit path and rigidly connected with the flat-form component 42, such that the additional flat-form components are mounted to rotate. An example of an arrangement of three rigidly connected flat-form components, which form a rotatable carrier, is described below with reference to FIGS. 13 through 15.

In all embodiments illustrated here, the opening 44 can be configured clearly larger than as indicated in the individual drawings. In particular, the opening 44 in each case is configured as large enough that a plug-in connection at the end of a conduit 10 can be fed through the opening 44. This can make it possible to use the conduit reservoir 20 with a ready-made conduit 10, durably connected with plug-in connections or other devices at both ends.

In all conduit reservoirs shown here, a tractive force on the conduit 10 can be translated into torque on the rotatable carrier 40 and vice versa. The translation ratio is determined by the length of the effective lever, that is, the distances of the straight lines along which the conduit 10 runs between the stationary guide rollers 26, 27 or the stationary fastening 28 on the one hand and the rollers 51, 52, 53, 54, 71, 72, 73 on the other hand, and the rotation axis 48 of the carrier 40. These distances or lever arms vary periodically during the rotation of the carrier 40.

Figure 9:
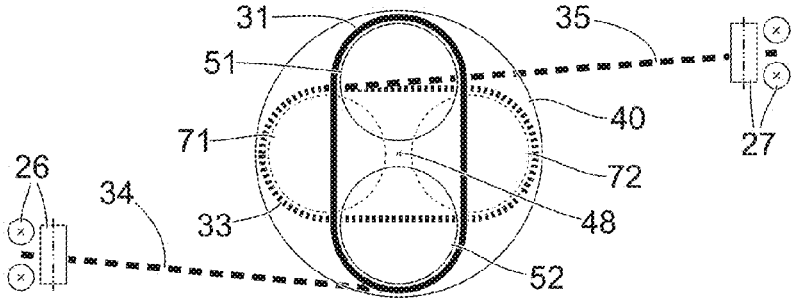
FIG. 9 shows a schematic depiction of portions of a conduit path of an additional conduit reservoir.

FIG. 9 shows a simple example of a conduit reservoir with only four rollers 51, 52, 71, 72 on a rotatable carrier 40. The two rollers 51, 52 on the side of the flat-form component 42 turned toward the observer define a first portion 31 of a conduit path. The two rollers 71, 72 positioned on the side of the flat-form component 42 turned away from the observer, and on the third portion 33 of the conduit path defined by them, are not visible and therefore are indicated only in broken lines. In the conduit reservoir illustrated in FIG. 9, the arrangement of the rollers 71, 73 and the third portion 33 of the conduit path defined by them are rotated by 90 degrees from the rollers 51, 52 and the first portion 31 of the conduit path. Between the stationary guide rollers 26, 27 on the one hand and the first portion 31 or the third portion 33 of the conduit path on the other hand, a conduit runs along essentially straight areas 34, 35 of the conduit path. To distinguish these straight areas 34, 35 from the first portion 31 and the third portion 33, they are illustrated likewise in broken lines, but with breaks at different intervals.

It can be recognized in FIG. 9 that the distance of the area 34 from the rotation axis 48 of the carrier 40 and thus the lever arm acting at this site on the one hand, and the distance of the area 35 from the rotation axis 48 and thus the lever arm acting at this site on the other hand, are markedly differentiated from one another. During a rotation of the carrier 40 around the rotation axis 48, the areas 34, 35 pivot back and forth periodically within a predetermined angle, and the lever arms vary accordingly. The two lever arms are approximately minimal and maximal in alternation in the arrangement of the first portion 31 and of the third portion 33 of the conduit path, rotated mutually by 90 degrees as shown in FIG. 9, and in the essentially centrically symmetrical arrangement of the stationary guide rollers 26, 27. The translation ratio, acting as a total, between a tractive tension on the conduit 10 and torque on the rotatable carrier 40 therefore varies more weakly than it would with a parallel arrangement of the first portion 31 and third portion 33 of the conduit path.

In the conduit reservoir described above with reference to FIG. 7, it is possible to achieve a similar reduction of the variation in the translation ratio between traction tension and torque, in that the arrangement of the rollers on the side of the flat-form component 42 turned away from the observer is rotated by 45 degrees from the arrangement of the rollers 51, 52, 53, 54 on the side of the flat-form component 42 turned toward the observer. Alternatively, the stationary guide rollers 27 can be slid by 45 degrees in relation to the rotation axis of the rotatable carrier 40.

In the conduit reservoir described with reference to FIG. 8, a similar reduction is possible in the variation of the translation ratio between tractive force and torque if the rollers on the side of the flat-form component 42 turned away from the observer, contrary to the depiction in FIG. 8, are positioned symmetrical to the rollers 51, 52, 53 on the side of the flat-form component 42 turned toward the observer, similarly as is the case in the conduit reservoir of FIGS. 2 through 6. Alternatively, the fastening 28 can be replaced by a fastening 29 that is positioned by sliding or pivoting 60 degrees from the rotation axis of the carrier 40. Another alternative consists in an arrangement of the guide rollers or fastenings at the same spot—similarly as in the conduit reservoir of FIGS. 2 through 6—by use of the rotatable carrier 40 from FIG. 8 with arrangements of the first portion 31 and of the third portion 33 of the conduit path that are rotated by 60 degrees with respect to one another.

It can be recognized in FIGS. 2 and 6 that in the illustrated position of the carrier 40 the conduit 10 runs over the roller 73 twice. To prevent the second bearing of the conduit 10 from gliding onto the roller 73 from the first bearing in the direction of the axis of the roller, additional guide devices, not shown in the drawings, can be foreseen. Alternatively the roller 73 can comprise a peripheral groove with a sufficient depth for intake of several bearings of the conduit 10.

Figure 10:
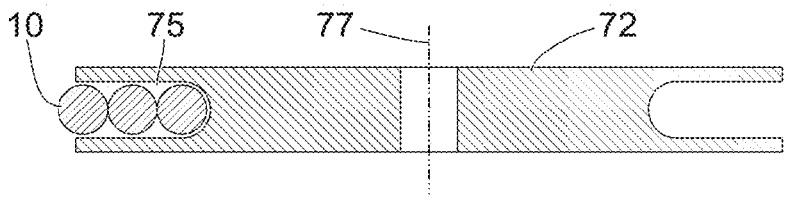
FIG. 10 shows a schematic depiction of a roller.

FIG. 10 shows a schematic sectional view of a variant of the roller 72, which can guide several bearings of the conduit 10. The illustrated sectional plane contains the rotation axis 77 of the roller 72. It can be recognized that the peripheral groove 75 of the roller 72 is configured deep enough so that it can simultaneously guide up to three bearings of the conduit 10.

Figure 11:
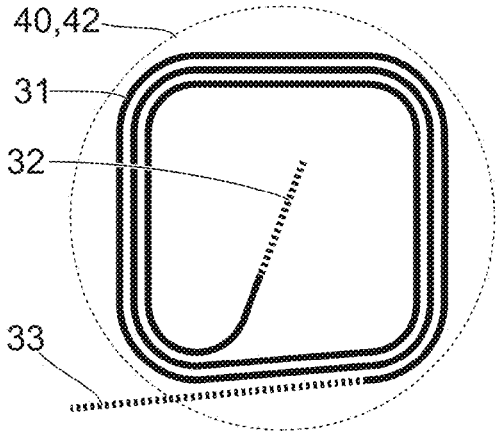
FIG. 11 shows a schematic depiction of portions of an additional conduit path.
Figure 12:
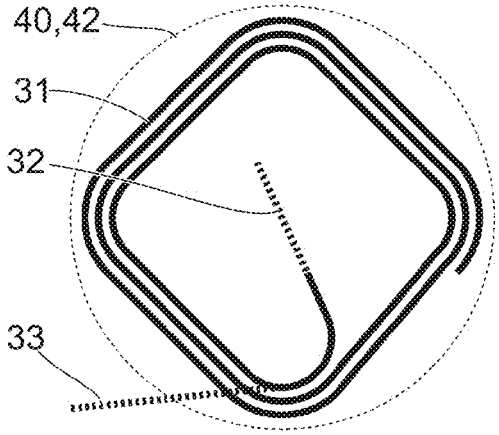
FIG. 12 shows a schematic depiction of the portions of the conduit path from FIG. 11.

FIGS. 11 and 12 show schematic depictions of a conduit path that can be produced in the first and third portions of the conduit path with four rollers each that, as indicated in FIG. 10, can each guide three bearings of the conduit 10 in the first and third portions of the conduit path. The planes of projection of FIGS. 11 and 12 are parallel to the two planes in which the first and second or third portions of the conduit path are situated, and perpendicular to the rotation axes of the carrier 40 and the rollers. In the interests of clarity of the illustration, only the first portion 31 (solid line), the second portion 32 (broken line) and an area 34 (broken line) of the conduit path bordering on the first portion 31 are shown, but not the rollers themselves. The positions of the rollers required for defining the first portion 31 of the conduit path are obvious. The third portion of the conduit path is, in particular—similarly as in the conduit reservoir form FIG. 7—symmetrical and largely parallel to the first portion 31, but not shown in FIGS. 11 and 12. To distinguish the first portion 31, the second portion 32 and the area 34 of the conduit path, these are depicted, as mentioned, in two different patterns.

FIGS. 11 and 12 show the carrier 40 in two different positions and situations. In the position shown in FIG. 11, a maximum quantity of a conduit is taken up in the conduit reservoir. The conduit is contained in the entire first portion 31 of the conduit path, and every roller guides three bearings of the conduit. The conduit is accordingly taken up in the entire third portion of the conduit path that is not depicted in FIG. 11, such that in the third portion as well, each roller guides three bearings of the conduit.

The situation illustrated in FIG. 12 is produced by rotation of the carrier 40 starting from the situation shown in FIG. 11 by almost three (more precisely: two and ⅞) full rotations in clockwise direction. The conduit is almost completely removed from the first portion 31 of the conduit path and now runs only in a brief area of the first portion 31 between the second portion 32 and the area 34 of the conduit path. The conduit is guided in the situation shown in FIG. 12 only by a single roller in the first portion 31 of the conduit path. Accordingly, the conduit is almost completely removed from the third portion of the conduit path, which is not illustrated in FIG. 12. Starting from the situation in FIG. 12, the carrier 40 can now continue to be rotated by about one-eighth of an entire rotation in clockwise direction, until the conduit is also completely lifted from the last roller, which in the situation in FIG. 12 still guides the conduit.

The example in FIGS. 11 and 12 shows that, with rollers of the type illustrated in FIG. 10, which can guide several bearings of the conduit 10, the intake capacity of the conduit reservoir can be multiplied. The advantages of increasing the intake capacity of the conduit reservoir in this manner are fully realized, in particular, by using a conduit 10 with a surface that ensures low friction between the bearings of the conduit 10.

Figure 13:
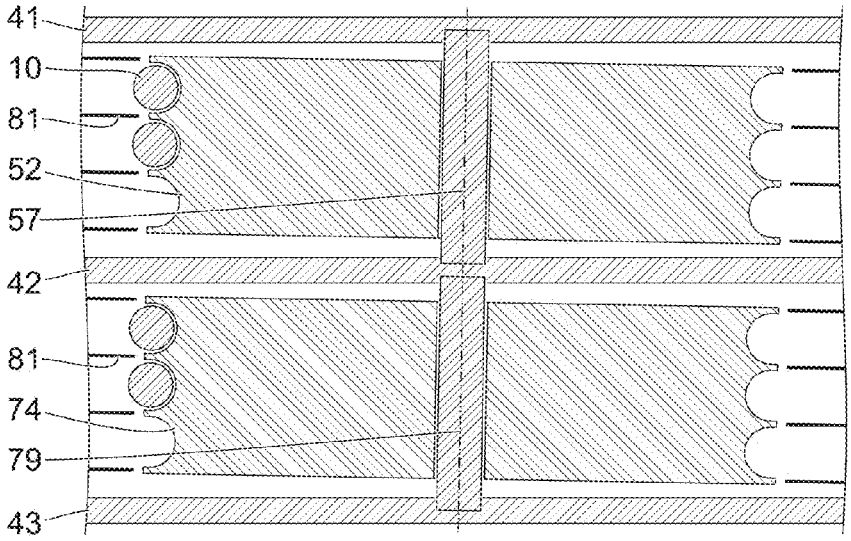
FIG. 13 shows a schematic depiction of an additional conduit reservoir.
Figure 14:
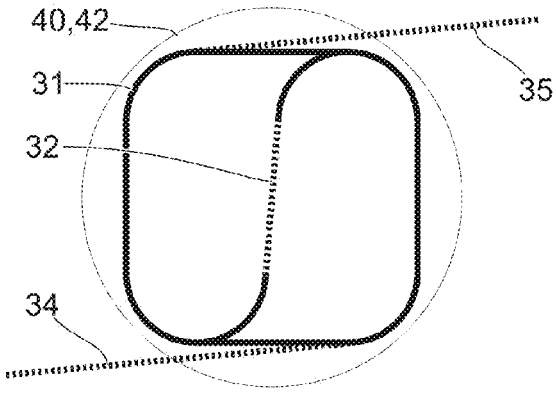
FIG. 14 shows a schematic depiction of portions of a conduit path of the conduit reservoir from FIG. 13.
Figure 15:
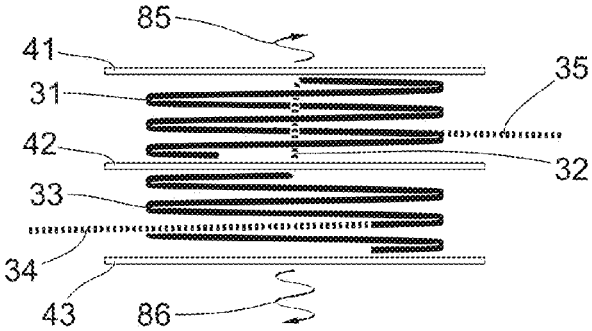
FIG. 15 shows another schematic depiction of the portions of the conduit path from FIGS. 13 and 14.

FIGS. 13 through 15 show an alternative configuration of a conduit reservoir in which the intake capacity is likewise markedly increased.

FIG. 13 shows a schematic sectional depiction of a roller 52 in the first portion 31 (compare FIGS. 14, 15) and a roller 74 in the third portion 33 of the conduit path of the conduit reservoir. Each of the rollers 52, 74 comprises three parallel grooves. The groove 52 on the first portion 31 of the conduit path is positioned between a first flat-form component 41 and a second flat-form component 42; the roller 74 in the third portion 33 of the conduit path is positioned between the second flat-form component 42 and a third flat-form component 43. The flat-form components 41, 42, 43 are rigidly connected with one another, in particular by the axles that define the rotation axes 57, 79 of the rollers 52, 74, and together form a rotatable carrier 40.

FIGS. 14 and 15—similarly as FIGS. 11 and 12—show only the portions and areas 31, 32, 33, 34, 35 of the conduit path and the circular contour of the carrier 40 (FIG. 14) or of the flat-form components 41, 42, 43 (FIG. 15). The positions of the rollers required for defining this conduit path are obvious. The portions and areas 31, 32, 33, 34, 35 of the conduit path are illustrated in different patterns to distinguish among them. The plane of projection of FIG. 14 is parallel to the flat-form components 41, 42, 43 and perpendicular to the rotation axis of the carrier 40. The plane of projection of FIG. 15 is parallel to the sectional plane of FIG. 13 and to the rotation axis of the carrier 40 and perpendicular to the plane of projection of FIG. 14.

It can be recognized in particular in FIG. 15 that the first portion 31 and third portion 33 of the conduit path each have a screw-type shape. The first portion 31 and third portion 33 of the conduit path are therefore each approximately curves of constant inclination on a mantle surface of a cylinder, which however does not have a circular cross-section but rather an approximately square cross-section with rounded corners corresponding to the radius of the rollers. The second portion 32 of the conduit path connects the first portion 31 and the third portion 33 by an opening through the second flat-form component 42. It can be seen in FIG. 13 that the rollers 52, 74 or their rotation axes 57, 79 are tipped at a small angle, in order to allow a low-friction passage of the conduit 10 into the spiral-type first and third portions 31, 33 of the conduit path.

In the situation illustrated in FIG. 15, the conduit is inserted at every roller into the upper and center groove, but not into the lower groove. In each case the bottom-most winding of the first portion 31 and third portion 33 of the conduit path is not occupied by the conduit 10. The arrow 85 above the first flat-form component 41 indicates that the conduit reservoir upon rotation of the carrier formed by the flat-form components 41, 42, 43 around a counter-clockwise rotation (based on the depiction in FIG. 14) can absorb a maximum quantity of the conduit 10 by insertion of the conduit into the lower grooves of the rollers in each case. Conversely, during two clockwise rotations of the carrier indicated by the arrow 86, the conduit 10 can be removed almost completely from the first portion 31 and third portion 33 of the conduit path.

The carrier is mounted in particular in such a way that a rotation of the carrier 40 by 360 degrees occurs with a sliding of the carrier parallel to its rotation axis by the distance of two neighboring grooves in one of the rollers 52, 74. This screw-type or helical movement is also indicated by the arrows 85, 86. These helical movements of the carrier make it possible to avoid, upon insertion of the conduit into the first portion 31 and third portion 33 of the conduit path or upon removal of the conduit 10 from the same, that pivoting movements of the areas 34, 35 of the conduit path neighboring on the first portion 31 or third portion 33 in the plane of projection of FIG. 15 become necessary.

In addition, to guide the conduit, guide plates 81, 83 are foreseen, which are indicated in FIG. 13. The guide plates each have a spiral shape on the first portion 31 and on the third portion 33 of the conduit path.

The conduit reservoirs 20 described here can each be equipped with a hose-shaped sterile covering or with a sterile sheath for the conduit 10. Sterile coverings or sterile sheaths are described, for example, in the publications DE 39 20 513 A1 and DE 10 2007 026 235 A1. On removing the conduit 10 from the conduit reservoir 20, the conduit 10, to the extent it is removed from the conduit reservoir, is automatically equipped with the sterile covering or sterile sheath. The conduit 10 and the inside of the conduit reservoir 20 are not therefore required to be sterile in order to permit their use in a sterile environment.

What is claimed is:

1. A conduit reservoir for intake of an electrical or optical cable or a hose or other conduit to conduct or transmit at least either a fluid, a signal or power, having:

a carrier, which is rotatable about a predetermined rotation axis;

conduit devices disposed on opposite sides of the carrier;

a conduit path defined by the conduit devices with a first portion, a second portion and a third portion, such that the conduit path is defined by the conduit devices in such a way that a conduit originally inserted into the second portion of the conduit path in a rotation of the carrier in a first rotation direction around the rotation axis is simultaneously inserted into the first portion and into the third portion of the conduit path; and an opening formed in the carrier for passage of the conduit, the opening providing the second portion of the conduit path to be non-parallel to the carrier;

such that the conduit devices are configured to allow a movement of the conduit along the conduit path.

2. The conduit reservoir according to claim 1, wherein the conduit devices include a roller that is rotatable with respect to the carrier.

3. The conduit reservoir according to claim 2, wherein a rotation axis of the roller is parallel to the rotation axis of the carrier.

4. The conduit reservoir according to claim 2, in addition having:

a first stationary guide device at an area of the conduit path that borders on the first portion of the conduit path;

a second stationary guide device at an area of the conduit path that borders on the third portion of the conduit path;

such that the rollers on the carrier and the stationary guide devices are arranged so that, in a predetermined position of the carrier, a first distance between a tangent through the first guide device on the first portion of the conduit path and the rotation axis of the carrier is essentially maximal, and a second distance between a tangent through the second guide device on the third portion of the conduit path and the rotation axis of the carrier is essentially minimal.

5. The conduit reservoir according to claim 2, in addition having:

a first stationary guide device at an area of the conduit path that borders on the first portion of the conduit path;

a second stationary guide device at an area of the conduit path that borders on the third portion of the conduit path;

such that the rollers on the carrier and the stationary guide devices are disposed so that a first angle between a first position of the carrier, in which a conduit guided by the first stationary guide device directly touches a first roller on the first portion of the conduit path, and a second position of the carrier, in which the conduit guided by the second stationary guide device directly touches a first roller on the third portion of the conduit path, and a second angle between the second position of the carrier and a third position of the carrier in which the conduit guided by the first stationary guide device directly touches a second roller neighboring on the first roller on the first portion of the conduit path, are essentially equal.

6. The conduit reservoir according to claim 5, wherein the guide devices include a glide surface.

7. The conduit reservoir according to claim 6, wherein the carrier includes a flat-form component having the opening, such that the second portion of the conduit path runs through the opening.

8. The conduit reservoir according to claim 1, wherein the first portion of the conduit path is positioned in a first plane and the third portion of the conduit path is positioned in a second plane, such that the first plane and the second plane are parallel to one another and perpendicular to the rotation axis of the carrier.

9. The conduit reservoir according to claim 8, wherein a carrier is situated between the first plane and the second plane.

10. The conduit reservoir according to claim 1, wherein the first portion and third portion of the conduit path are disposed parallel to one another, at least in portions, and such that the second portion connects the first portion and third portion in such a way that a conduit moving along the conduit path moves in contrary directions in the first portion and in the third portion.

11. The conduit reservoir according to claim 1, in addition having:

a torque source that is coupled with the carrier in order to exert torque in the first rotation direction on the carrier.

12. The conduit reservoir according to claim 1, wherein conduit devices on the first portion of the conduit path and the conduit devices on the third portion of the conduit path are disposed and configured in each case in such a way that the first portion of the conduit path and the third portion of the conduit path each encircle the rotation axis of the carrier more than once.

13. The conduit reservoir according to claim 12, wherein the first portion and third portion of the conduit path each encircle the rotation axis of the carrier in spiral or screw-type manner.

14. The conduit reservoir according to claim 13, wherein the first portion and third portion of the conduit path each encircle the rotation axis of the carrier in screw-type manner with a predetermined pitch, such that the carrier is mounted in such a way that a rotation of the carrier by 360 degrees is connected with an axial sliding of the carrier by a predetermined pitch.

* * * * *